US010954048B1

(12) United States Patent
Charters

(10) Patent No.: US 10,954,048 B1
(45) Date of Patent: Mar. 23, 2021

(54) HANGING POCKET WITH TAMPER DETECTION

(71) Applicant: Park Communications, LLC, Morrisville, NC (US)

(72) Inventor: Andrew Cunningham Charters, Cary, NC (US)

(73) Assignee: Park Communications, LLC, Morrisville, NC (US)

( * ) Notice: Subject to any disclaimer, the term of this patent is extended or adjusted under 35 U.S.C. 154(b) by 0 days.

(21) Appl. No.: 16/737,598

(22) Filed: Jan. 8, 2020

Related U.S. Application Data

(63) Continuation of application No. 16/665,896, filed on Oct. 28, 2019.

(51) Int. Cl.
*B65D 75/14* (2006.01)
*B65D 75/52* (2006.01)
*B65D 75/56* (2006.01)

(52) U.S. Cl.
CPC ..... *B65D 75/14* (2013.01); *B65D 75/522* (2013.01); *B65D 75/566* (2013.01); *B65D 2575/565* (2013.01)

(58) Field of Classification Search
CPC .... B65D 75/14; B65D 75/20; B65D 73/0078; B65D 5/2076; B65D 5/4208
USPC ..... 229/103.2, 87.1, 87.01, 87.03, 87.34, 229/87.06
See application file for complete search history.

(56) References Cited

U.S. PATENT DOCUMENTS

| | | | | | |
|---|---|---|---|---|---|
| 3,295,741 | A * | 1/1967 | Meyers | B65D 75/14 | 229/103.3 |
| 4,174,041 | A * | 11/1979 | Turner | B65D 5/0005 | 229/103.3 |
| 4,974,770 | A * | 12/1990 | Wright | B65D 75/14 | 206/455 |
| 5,156,331 | A * | 10/1992 | Pirre | B65D 5/545 | 206/455 |
| 5,248,032 | A * | 9/1993 | Sheu | B65D 85/546 | 206/308.1 |
| 6,564,994 | B2 * | 5/2003 | Makofsky | B65D 5/0005 | 229/313 |
| 8,534,535 | B2 * | 9/2013 | Nickell | B65D 27/04 | 229/71 |
| 2001/0022318 | A1 * | 9/2001 | Kaden | B65D 75/566 | 229/80 |

(Continued)

FOREIGN PATENT DOCUMENTS

| | | | | |
|---|---|---|---|---|
| DE | 20002554 U1 * | 5/2000 | ..... | B65D 5/4208 |
| EP | 2030913 A1 * | 3/2009 | ..... | B65D 75/14 |
| FR | 2816919 A3 * | 5/2002 | ..... | B65D 75/54 |

*Primary Examiner* — Christopher R Demeree
*Assistant Examiner* — Phillip D Schmidt
(74) *Attorney, Agent, or Firm* — Coats & Bennett, PLLC

(57) ABSTRACT

A hanging pocket for point-of-sale display is provided. The hanging pocket comprises a front panel, an upper rear panel connected to a top edge of the front panel long an upper fold line, and a lower rear panel connected to a bottom edge of the front panel along a lower fold line. The upper and lower rear panels are configured to fold towards the front panel to form a pocket with open sides. First and second side flaps connected to lateral edges of front panel fold inwardly and join with both the upper and lower rear panels to enclose open sides of the pocket.

12 Claims, 6 Drawing Sheets

(56) References Cited

U.S. PATENT DOCUMENTS

| | | | | |
|---|---|---|---|---|
| 2013/0233763 | A1* | 9/2013 | Bulls, Jr. | B65D 73/0078 206/767 |
| 2014/0374471 | A1* | 12/2014 | Jones | B65D 73/0078 229/103.2 |
| 2019/0248556 | A1* | 8/2019 | Wang | B65D 65/12 |

* cited by examiner

HANGING POCKET WITH TAMPER DETECTION

RELATED APPLICATIONS

This application is a continuation of prior application Ser. No. 16/665,896, filed 28 Oct. 2019, the disclosure of which is incorporated herein in its entirety by reference.

TECHNICAL FIELD

The present disclosure relates generally to packages for point of sale display and, more particularly, to a hanging pocket for displaying a package of trading cards at the point of sale.

BACKGROUND

Folding pockets for trading cards are known in the art as exemplified by U.S. Pat. No. 9,701,455 and U.S. Publication 2001/0022318. The folding pocket typically comprises two panels, denoted herein as the front and rear panels, that are joined along a fold line. One of the panels typically includes side flaps extending along the lateral edges of the panel. The panels are folded towards one another and the side flaps are folded inwardly to form a pocket for the trading cards, which are typically inside a foil package. The front and rear panels are secured together by adhesive. Additionally, the side flaps on the front or rear panel are secured to the opposing panel by an adhesive. The front and rear panels typically include an aperture for suspending the package on a hanger for display.

A problem with the hanging pockets as described above is that a malicious party can use a knife or thin blade to separate the side flap from the front or rear panel to gain access to the foil pack inside the hanging pocket, remove one or two high value trading cards from the foil package, and replace the tampered foil package back into the hanging pocket. The tampering can be concealed by tucking the side flap back underneath the front or rear panel. An unsuspecting customer may then purchase the trading cards only to discover that one or two trading cards are missing from the package. While the customer may return the package to the point of purchase, the card manufacturer or retailer typically feels obliged to replace the missing cards at far greater overall cost than the loss from the initial theft itself. The losses to the manufacturer or retailer include the cost of the replacement cards plus related expenses such as employee time, postage, materials, etc.

Accordingly, there continues to be a need for a hanging pocket for trading cards having features that make tampering more evident without compromising the visual appeal of the packaging.

SUMMARY

The present disclosure relates to a hanging pocket for point-of-sale display. The hanging pocket comprises a front panel, an upper rear panel connected to a top edge of the front panel along an upper fold line, and a lower rear panel connected to a bottom edge of the front panel along a lower fold line. The upper and lower rear panels are configured to fold towards the back side of the front panel to form a pocket with open sides. First and second side flaps connected to the lateral edges of front panel fold inwardly and join with both the upper and lower rear panels to enclose the open sides of the pocket.

The design of the hanging pocket enables better detection of tampering. If the seal between the side flaps and the upper rear panel or lower rear panel is broken, the upper rear panel or lower rear panel will no longer be secured and the tampering will be evident.

DETAILED DESCRIPTION

Figure 1:
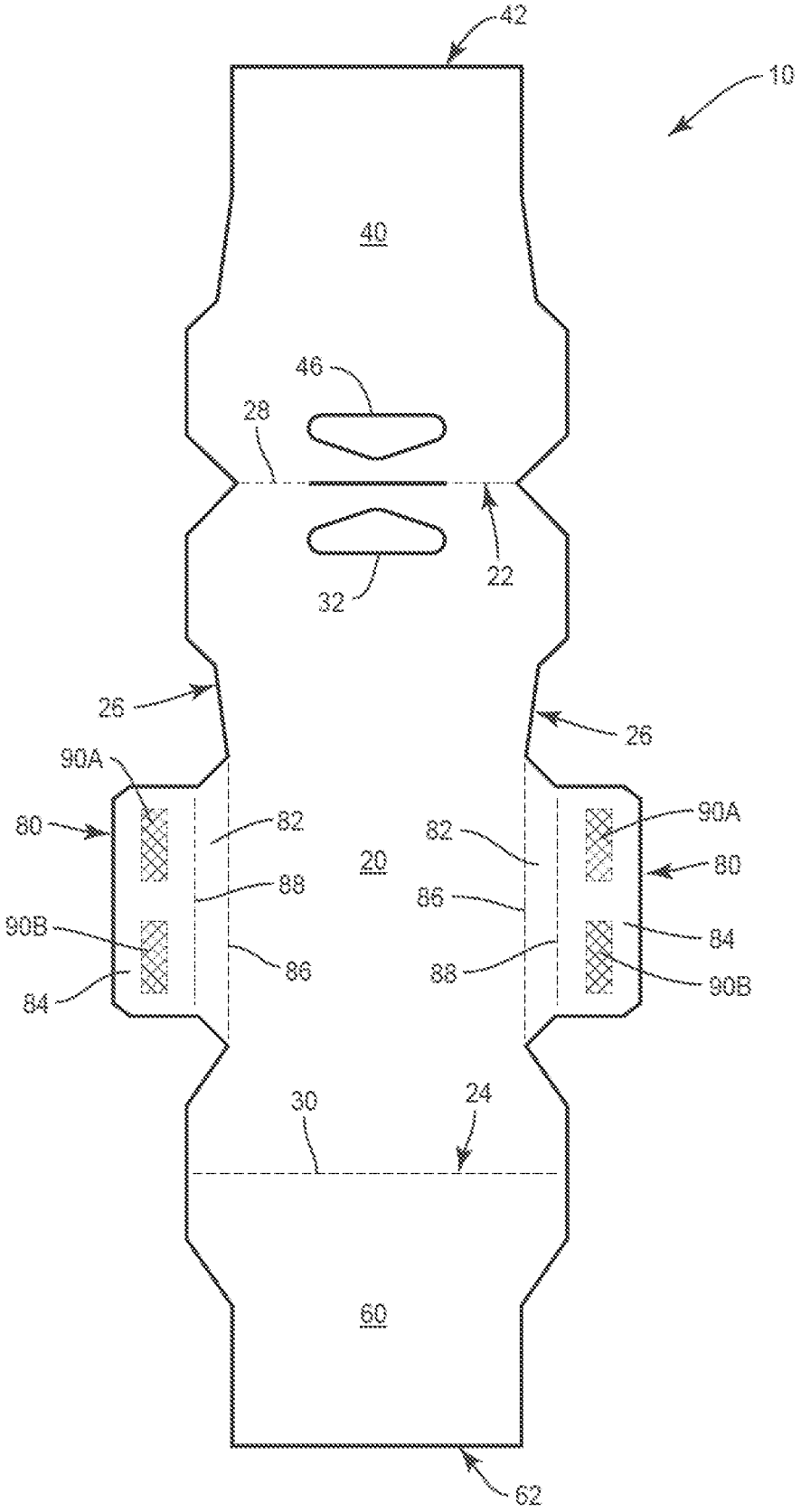
FIG. 1 is a plan view showing the outside of a blank used to make a hanging pocket.

Referring now to the drawings, an exemplary embodiment of a hanging pocket indicated generally by the numeral 10 is shown. The hanging pocket 10 shown and described herein is designed for use as a point of display for trading cards. Those skilled in the art will appreciate, however, that the hanging pocket 10 may be used for a variety of goods in addition to trading cards.

Figure 2:
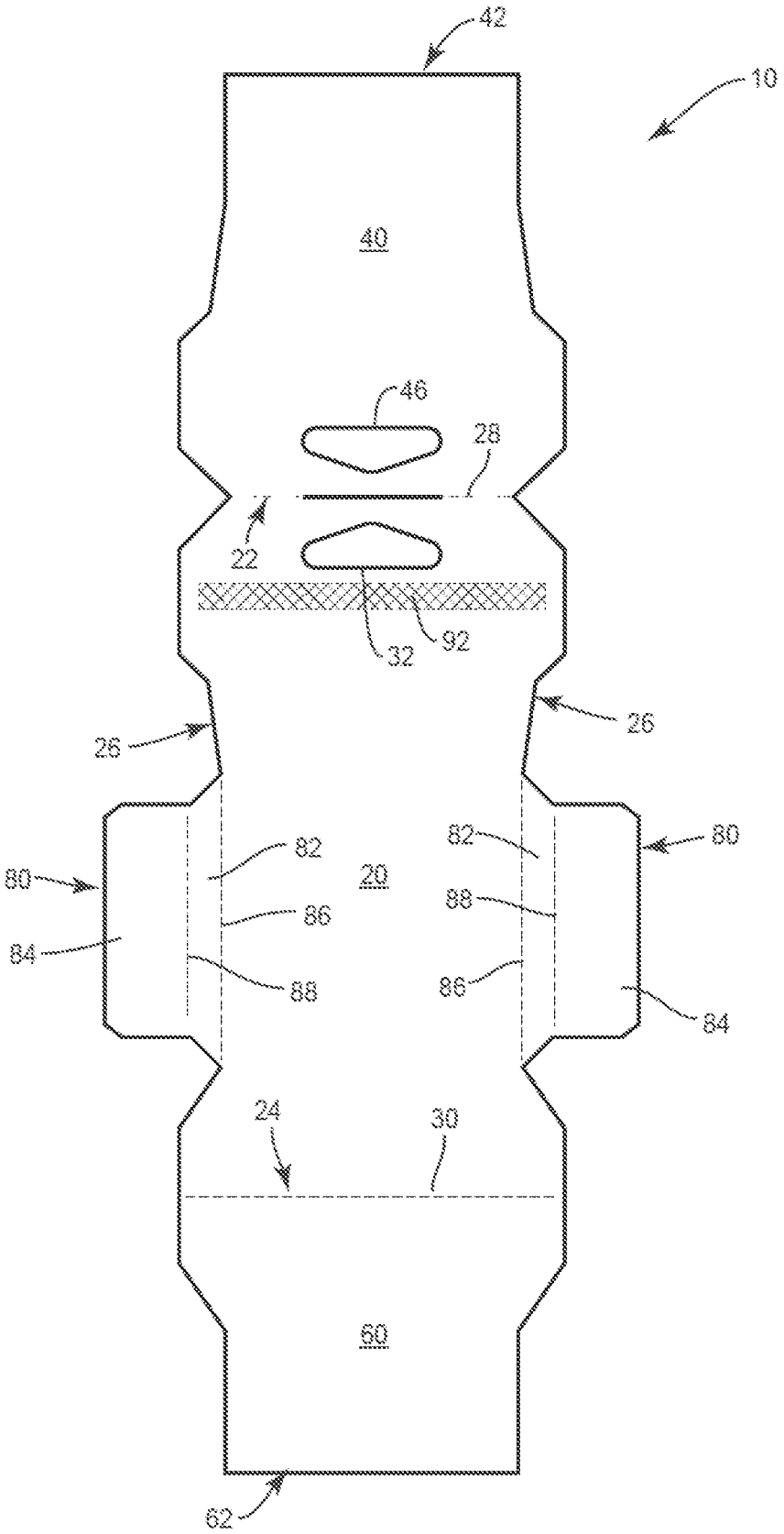
FIG. 2 is a plan view showing the inside of a blank used to make a hanging pocket.
Figure 3:
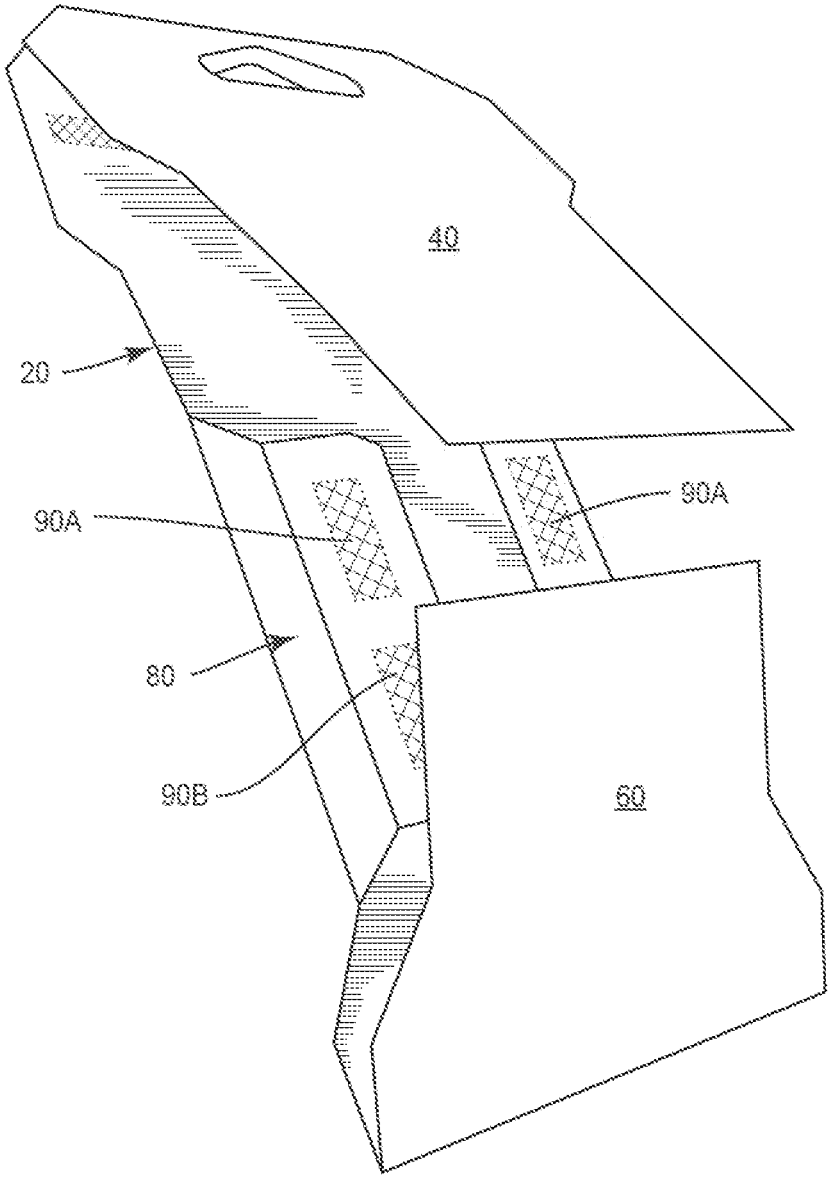
FIG. 3 is a perspective view of the blank being folded to form the hanging pocket.

FIGS. 1 and 2 illustrate a card blank that is used to form the hanging pocket 10. The hanging pocket 10 generally comprises a front panel 20, an upper rear panel 40 connected to a top edge 22 of the front panel 20 along an upper fold line 28, a lower rear panel 60 connected to a bottom edge 24 of the front panel 20 along a lower fold line 30, and side flaps 80 connected along respective lateral edges 26 of the front panel 20 along primary fold lines 86. The upper rear panel 40 and lower rear panel 60 fold towards the inside of the front panel 20 along fold lines 28 and 30 with the trading cars or other product placed on the front panel 20 to form a pocket with open sides. The side flaps 80 fold upwardly and inwardly to enclose the open sides of the pocket as shown in FIG. 3. The side flaps 80 are adhered to the upper rear panel 40 and lower rear panel 60 by an adhesive to seal the hanging pocket 10.

Figure 4:
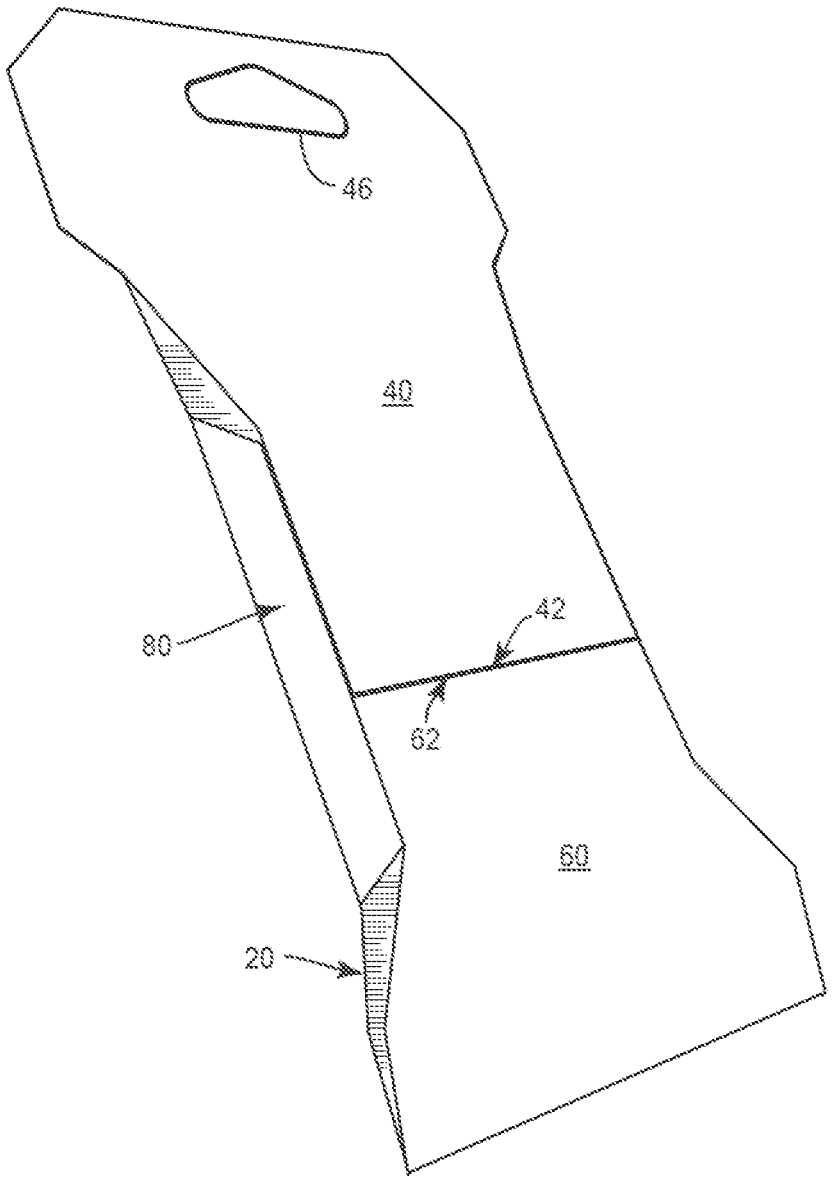
FIG. 4 is a perspective view of the hanging pocket from the rear after sealing.
Figure 5:
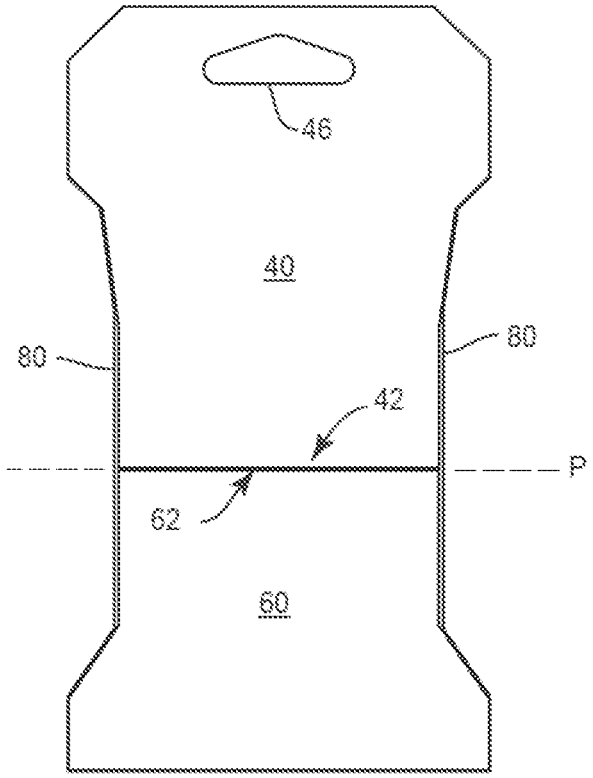
FIG. 5 is a rear view of the hanging pocket after sealing.

FIGS. 4 and 5 illustrate the hanging pocket after it has been sealed. As shown in FIGS. 4 and 5, the outer ends 42 and 62 of the upper rear panel 40 and lower rear panel 60 respectively are sealed to both side flaps 80. The outer ends 42 and 62 of the upper rear panel 40 and lower rear panel 60 respectively meet along a parting line P that extends transversely to a longitudinal axis of the card blank. The parting line P generally bisects the side flaps 80, thus providing room to secure the upper rear panel 40 and lower rear panel 60 to each side flap 80.

In an exemplary embodiment, each side flap 80 comprises a first portion 82 that connects to a lateral side edge 26 of the front panel 12 along the primary fold line 84 and a second portion 84 that connects to the first portion 82 along a secondary fold line 88. When the blank is folded to form the hanging pocket 10, the first portion 82 of the side flaps 80 folds upwardly along the primary fold line 86 into a plane generally perpendicular to the front panel 20. The second portion 84 of the side flap 80 folds downward along the secondary fold line 88 into a plane generally parallel to the front panel 20. Adhesive is applied on an outside surface of the second portion 84 for adhering to the upper rear panel 40 and lower rear panel 60. In one exemplary embodiment, the second portion 84 of the side flaps 80 includes two adhesive areas 90 disposed on opposite sides of the parting line P where the outer ends 42 and 62 of the upper rear panel 40 and lower rear panel 60 meet. The area of the second portion 84 along the parting line P (between adhesive areas 90) is free of adhesive. Adhesive area 90A is for securing the upper rear panel 60 to the side flap 80, while adhesive area 90B is for securing the lower rear panel 60 to the side flap 80.

In some embodiments, the front panel 20 and upper rear panel 40 include apertures 32 and 46 respectively for suspending the hanging pocket from a display hanger. Positioning the apertures 32 and 46 close to the folding line 28 allows for more accurate registration of the apertures 32, 46 when the upper rear panel 40 is folded.

In some embodiments, an adhesive 92 is applied to the inside surface of the front panel 12 or upper rear panel 40 to secure the front panel 20 and upper rear panel 40 and prevent the product inside from shifting. The adhesive 92 is preferably applied to the front panel 20 or upper rear panel 40 in an area adjacent the fold line 44.

Though not shown in the drawings, text and graphics can be printed on the outside surfaces of the hanging pocket 10 for marketing purposes. An advantage of the design is that the entire area of the front panel 20 is free of fold lines or perforations that would interfere with the graphics.

Figure 6:
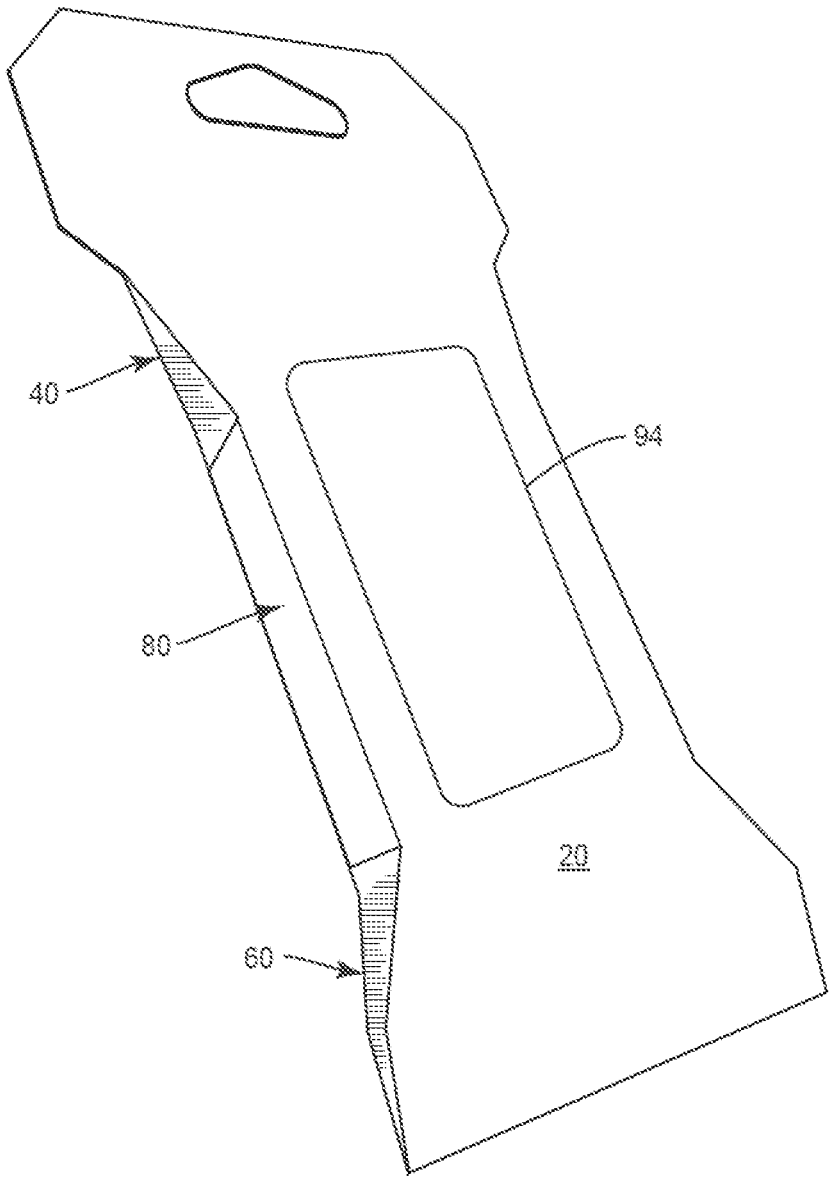
FIG. 6 is a perspective view of a hanging pocket from the front after sealing.

The design of the hanging pocket 10 also allows a product window 94 to be formed in the front panel 20 as shown in FIG. 6 so that consumers can see the products inside the hanging pocket 10. The side flaps 80 in the hanging pocket 10 seal to the upper panel 40 and lower rear panel 60, rather than to the front panel 20, so that the entire front panel 20 is available for the product window 94.

The design of the hanging pocket 10 enables better detection of tampering without compromising the visual appeal of the packaging. The entire area of the front panel 20 is available for graphics and/or a product window. If the seal between the side flaps 80 and the upper rear panel 40 or lower rear panel 60 is broken, the outer end 42, 62 of the upper rear panel 40 or lower rear panel 60 will no longer be secured and the tampering will be evident. In contrast, with prior art designs the side flaps 80 could simply be tucked in after the trading cards are removed, leaving no clearly visible evidence of the tampering.

What is claimed is:

1. A hanging pocket for point-of-sale display, the hanging pocket comprising:

a front panel;

an upper rear panel connected to a top edge of the front panel and configured to fold towards the front panel along a first fold line;

a lower rear panel connected to a bottom edge of the front panel and configured to fold towards the front panel along a second fold line; and first and second side flaps connected to the opposing side edges of front panel along respective primary fold lines, each side flap being configured to join with both the upper and lower rear panels to form a sealed package, the first and second side flaps are spaced away from the top edge and the bottom edge;

in a folded configuration, the upper and lower rear panels overlap with the front panel and connect to the first and second side flaps to form an interior space and the first and second flaps extend along lateral sides of the interior space with openings on each of the lateral sides in communication with the interior space;

wherein the upper rear panel and lower rear panel include outer edges and are configured so that the outer edges meet along a parting line that extends transversely relative to the hanging pocket when the upper rear panel and lower rear panel are folded.

2. The hanging pocket of claim 1 wherein each of the side flaps comprises:

a first portion connected to one of the opposing side edges of the front panel along the primary fold line; and a second portion connected to the first portion along a secondary fold line and configured to engage each of the upper rear panel and lower rear panel to form a sealed package.

3. The hanging pocket of claim 2 wherein the second portion of each side flap is secured to both the upper rear panel and lower rear panel by adhesive.

4. The hanging pocket of claim 3 wherein the adhesive comprises a first adhesive area on the second portion of each side flap for securing the side flap to the upper rear panel and a second adhesive area on the second portion of each side flap for securing the side flap to the lower rear panel.

5. The hanging pocket of claim 4 wherein the first and adhesive areas are disposed on opposite sides of the parting line to form an adhesive free area along the parting line.

6. The hanging pocket of claim 1 further comprising first and second apertures formed in the front panel and upper panel respectively adjacent the first fold line.

7. The hanging pocket of claim 6 further comprising an adhesive applied to the inside surface of the front panel or upper rear panel to adhere the front panel and upper rear panel together.

8. The hanging pocket of claim 7 wherein the adhesive is applied to the front panel and surrounds the aperture on the front panel.

9. The hanging pocket of claim 1 wherein the front panel includes a window enabling a consumer to see a product contained in the hanging pocket.

10. The hanging pocket of claim 1 wherein the openings comprise first openings that are formed between the first and second side flaps and the upper rear panel and second openings that are formed between the first and second side flaps and the lower rear panel.

11. The hanging pocket of claim 1 wherein the front panel comprises a length measured between the top edge and the bottom edge, the first and second side flaps are shorter than the front panel measured along the length.

12. The hanging pocket of claim 1 wherein the upper rear panel and the lower rear panel overlap with the first and second side flaps in the folded configuration.

* * * * *